US008158901B2

(12) United States Patent
Fan

(10) Patent No.: US 8,158,901 B2
(45) Date of Patent: Apr. 17, 2012

(54) SLIDING KEY MECHANISM CAPABLE OF BEING FASTENED TIGHTLY DUE TO INTERFERENCE GENERATED BY ELASTIC FORCE AND RELATED ELECTRONIC DEVICE

(75) Inventor: Chin-Lung Fan, Taipei Hsien (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 392 days.

(21) Appl. No.: 12/483,224

(22) Filed: Jun. 11, 2009

(65) Prior Publication Data

US 2010/0155207 A1 Jun. 24, 2010

(30) Foreign Application Priority Data

Dec. 22, 2008 (TW) ..... 97150060 A

(51) Int. Cl.
*H01H 15/02* (2006.01)

(52) U.S. Cl. ..... 200/547

(58) Field of Classification Search ..... 200/547, 200/329, 531, 536, 548–550
See application file for complete search history.

(56) References Cited

U.S. PATENT DOCUMENTS

| | | | | |
|---|---|---|---|---|
| 6,100,479 | A * | 8/2000 | Fust et al. | 200/329 |
| 6,822,174 | B1 * | 11/2004 | Spies | 200/329 |
| 6,989,504 | B1 * | 1/2006 | Wu | 200/547 |
| RE40,055 | E | 2/2008 | Tseng et al. | |
| 7,348,511 | B2 * | 3/2008 | Chen et al. | 200/296 |
| 7,638,722 | B2 * | 12/2009 | Iijima | 200/547 |
| 2008/0060929 | A1 * | 3/2008 | Iijima | 200/547 |

FOREIGN PATENT DOCUMENTS

| | | | |
|---|---|---|---|
| CN | 1076054 | A | 9/1993 |
| GB | 2265255 | A | 9/1993 |
| JP | 63199432 | U | 12/1988 |

OTHER PUBLICATIONS

Office action mailed on Aug. 3, 2011 for the China application No. 200910000011.9, p. 3 line 12 and line 18 and line 21 and line 25~27, p. 4 line 3 and line 6~16 and line 19~21 and line 24~30, p. 5 line 2~5 and line 8~11.

* cited by examiner

*Primary Examiner* — Briggitte R Hammond

(74) *Attorney, Agent, or Firm* — Winston Hsu; Scott Margo

(57) ABSTRACT

The sliding key mechanism includes a main body fixed inside a slot on a housing, a sliding actuator connected to a side of the main body for containing a sliding head of a sliding switch, a key portion connected to the other side of the main body for driving the sliding actuator simultaneously when the key portion slides so that the sliding actuator slides the sliding head of the sliding switch, and two elastic components connected to both ends of the main body respectively, and the two elastic components being bent when the main body is fixed inside the slot on the housing so that the two elastic components contact against the housing elastically.

20 Claims, 8 Drawing Sheets

SLIDING KEY MECHANISM CAPABLE OF BEING FASTENED TIGHTLY DUE TO INTERFERENCE GENERATED BY ELASTIC FORCE AND RELATED ELECTRONIC DEVICE

BACKGROUND OF THE INVENTION

1. Field of the Invention

The present invention relates to a sliding key mechanism and a related electronic device, and more particularly, to a sliding key mechanism capable of being fastened tightly due to interference generated by elastic force and a related electronic device.

2. Description of the Prior Art

In the modern information-oriented society, it is desirable that users can input control instructions with a user-friendly human-machine interface. For example, there are various kinds of switches. A sliding switch is usually used in a wireless communication module of a notebook computer. However, it is difficult to control a gap of components of a sliding key mechanism for the sliding switch resulting in seesaw and swaying drawbacks. It debases using feeling of the sliding switch.

SUMMARY OF THE INVENTION

According to the claimed invention, a sliding key mechanism includes a main body fixed inside a slot on a housing, a sliding actuator connected to a side of the main body for containing a sliding head of a sliding switch, a key portion connected to the other side of the main body for driving the sliding actuator simultaneously when the key portion slides so that the sliding actuator slides the sliding head of the sliding switch, and two elastic components connected to both ends of the main body respectively, and the two elastic components being bent when the main body is fixed inside the slot on the housing so that the two elastic components contact against the housing elastically.

According to the claimed invention, a hook structure is formed on an end of the main body for wedging into the slot on the housing.

According to the claimed invention, the sliding actuator comprises two lateral walls against the sliding head in a direction whereto the sliding actuator slides the sliding head.

According to the claimed invention, the sliding actuator comprises a protrusion against the sliding head perpendicularly to a direction whereto the sliding actuator slides the sliding head.

According to the claimed invention, a plurality of rib structures is formed on the key portion.

According to the claimed invention, each elastic component is a cantilever.

According to the claimed invention, a dome is formed on each cantilever for contacting against the housing so as to bend the two elastic components.

According to the claimed invention, the two elastic components and the main body are connected integrally.

According to the claimed invention, an electronic device includes a housing whereon a slot is formed, a circuit board installed inside the housing, a sliding switch installed inside the housing and disposed on the circuit board. The sliding switch includes a sliding head. The electronic device further includes a sliding key mechanism installed on the housing. The sliding key mechanism includes a main body fixed inside the slot on the housing, a sliding actuator connected to a side of the main body for containing the sliding head of the sliding switch, a key portion connected to the other side of the main body for driving the sliding actuator simultaneously when the key portion slides so that the sliding actuator slides the sliding head of the sliding switch, and two elastic components connected to both ends of the main body respectively, and the two elastic components being bent when the main body is fixed inside the slot on the housing so that the two elastic components contact against the housing elastically.

According to the claimed invention, the electronic device is a notebook computer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
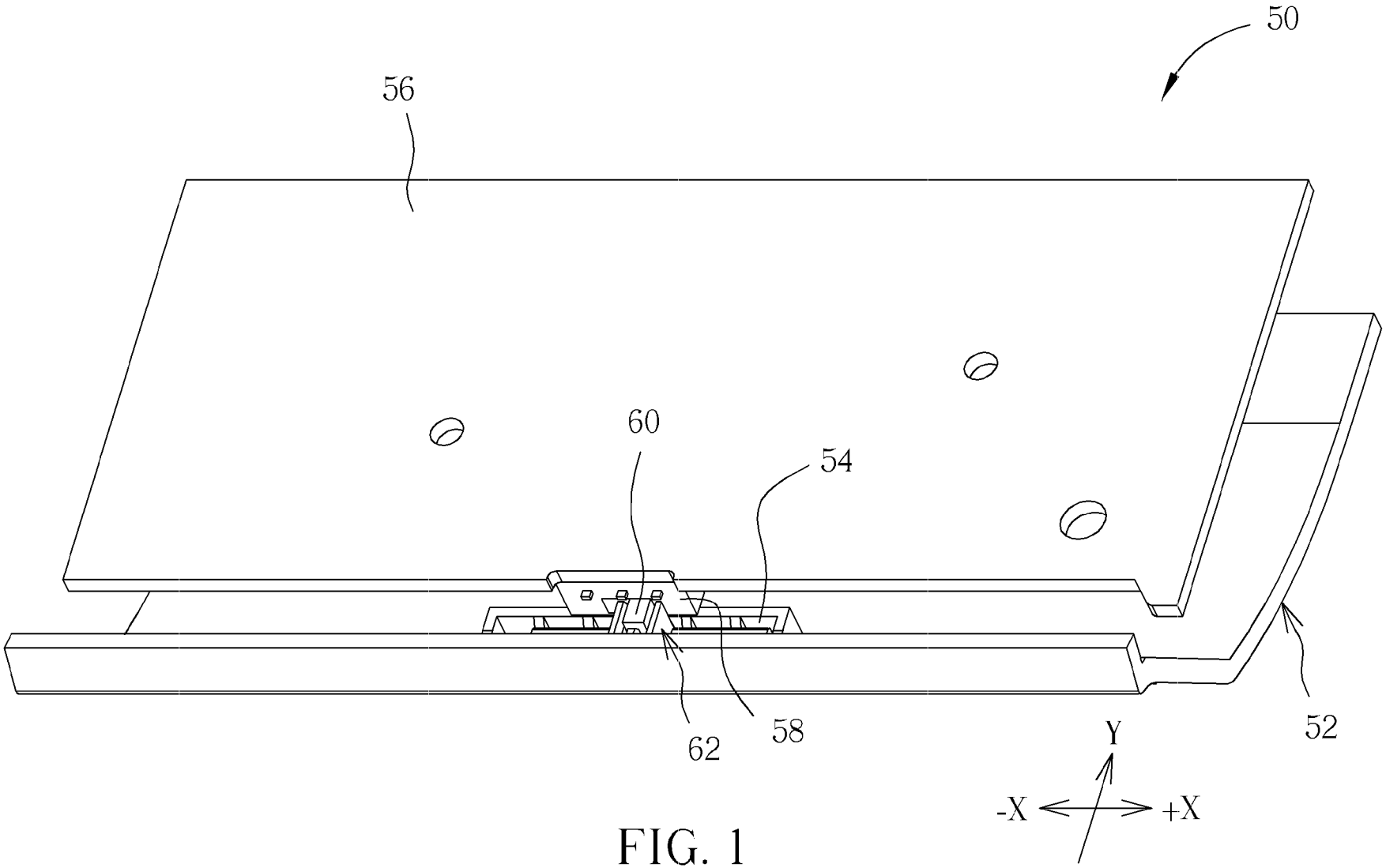
FIG. 1 and FIG. 2 are diagrams of internal structure of an electronic device in different views according to a preferred embodiment of the present invention.
Figure 2:
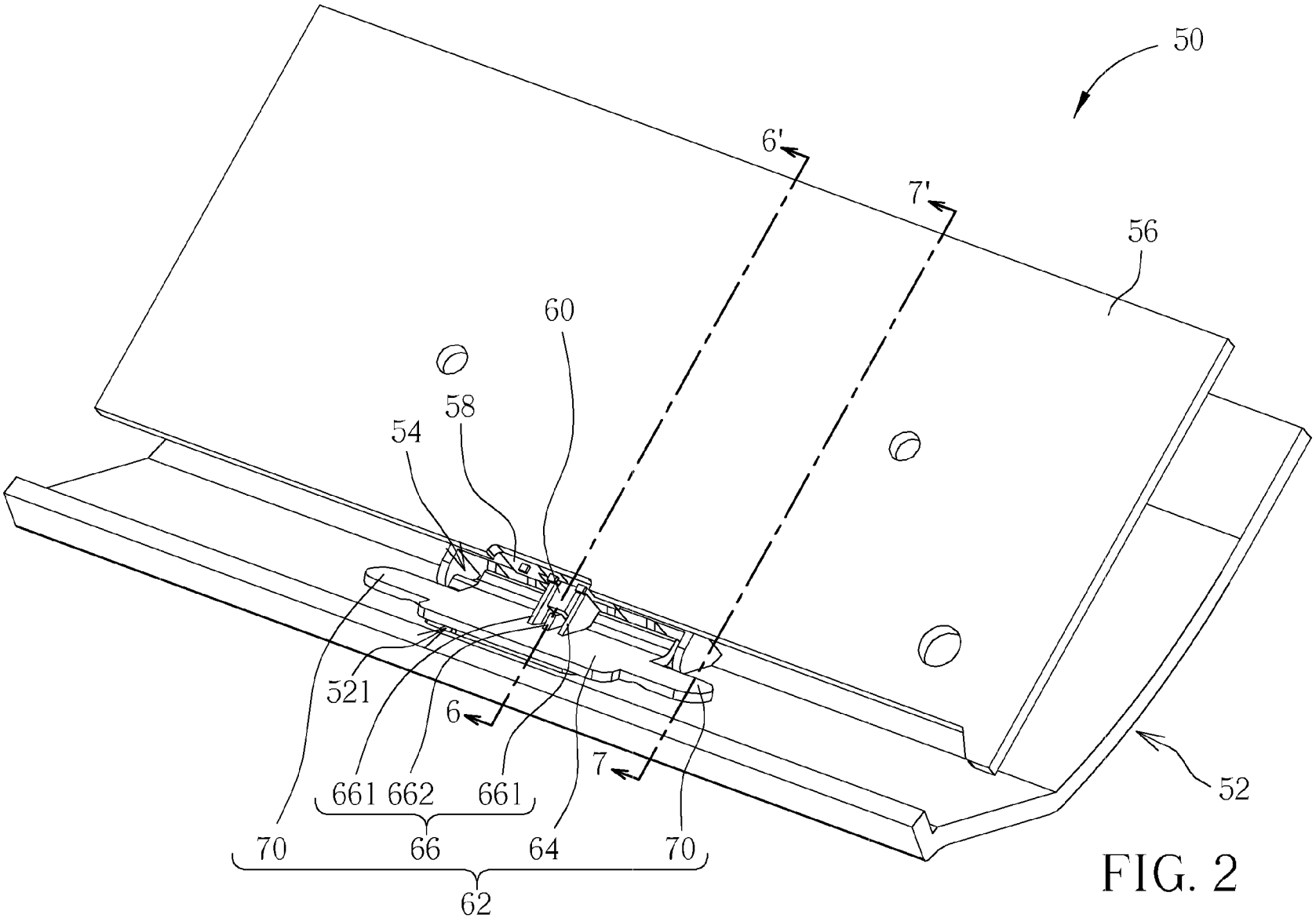
Figure 3:
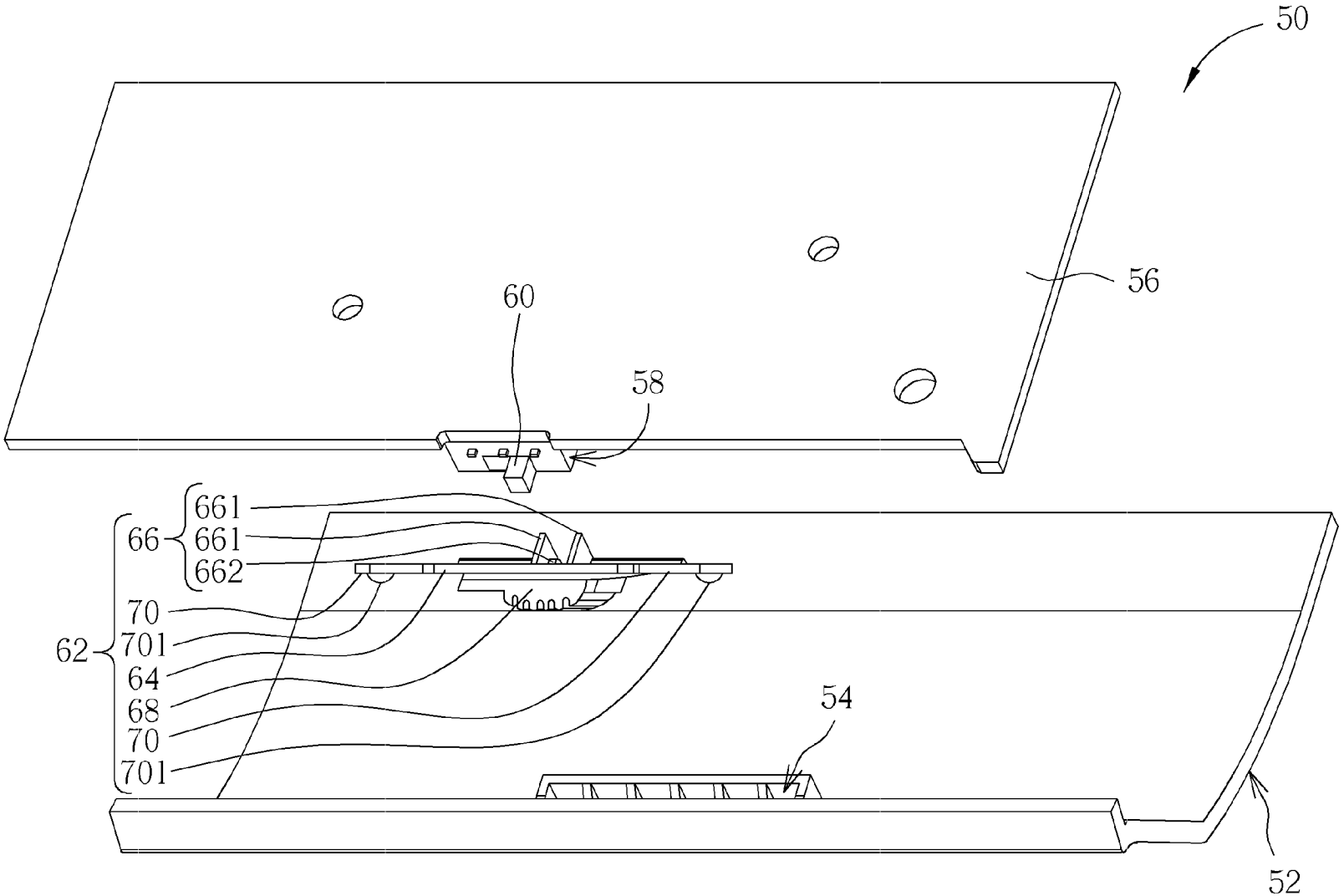
FIG. 3 is an exploded diagram of the electronic device according to the preferred embodiment of the present invention.

Please refer to FIG. 1 to FIG. 3. FIG. 1 and FIG. 2 are diagrams of internal structure of an electronic device 50 in different views according to a preferred embodiment of the present invention. FIG. 3 is an exploded diagram of the electronic device 50 according to the preferred embodiment of the present invention. The electronic device 50 can be a computer device, such as a notebook computer. The electronic device 50 includes a housing 52 for covering internal components. A slot 54 is formed on the housing 52. The electronic device 50 further includes a circuit board 56 installed inside the housing 52, and a sliding switch 58 installed inside the housing 52 and disposed on the circuit board 56. The sliding switch 58 includes a sliding head 60. The electronic device 50 further includes a sliding key mechanism 62 installed on the housing 52. A user can slides the sliding key mechanism 62 to drive the sliding head 60 of the sliding switch 58 in different positions so as to switch the sliding switch 58 at different function modes, such as actuating or disabling a wireless communication module of a notebook computer.

Figure 4:
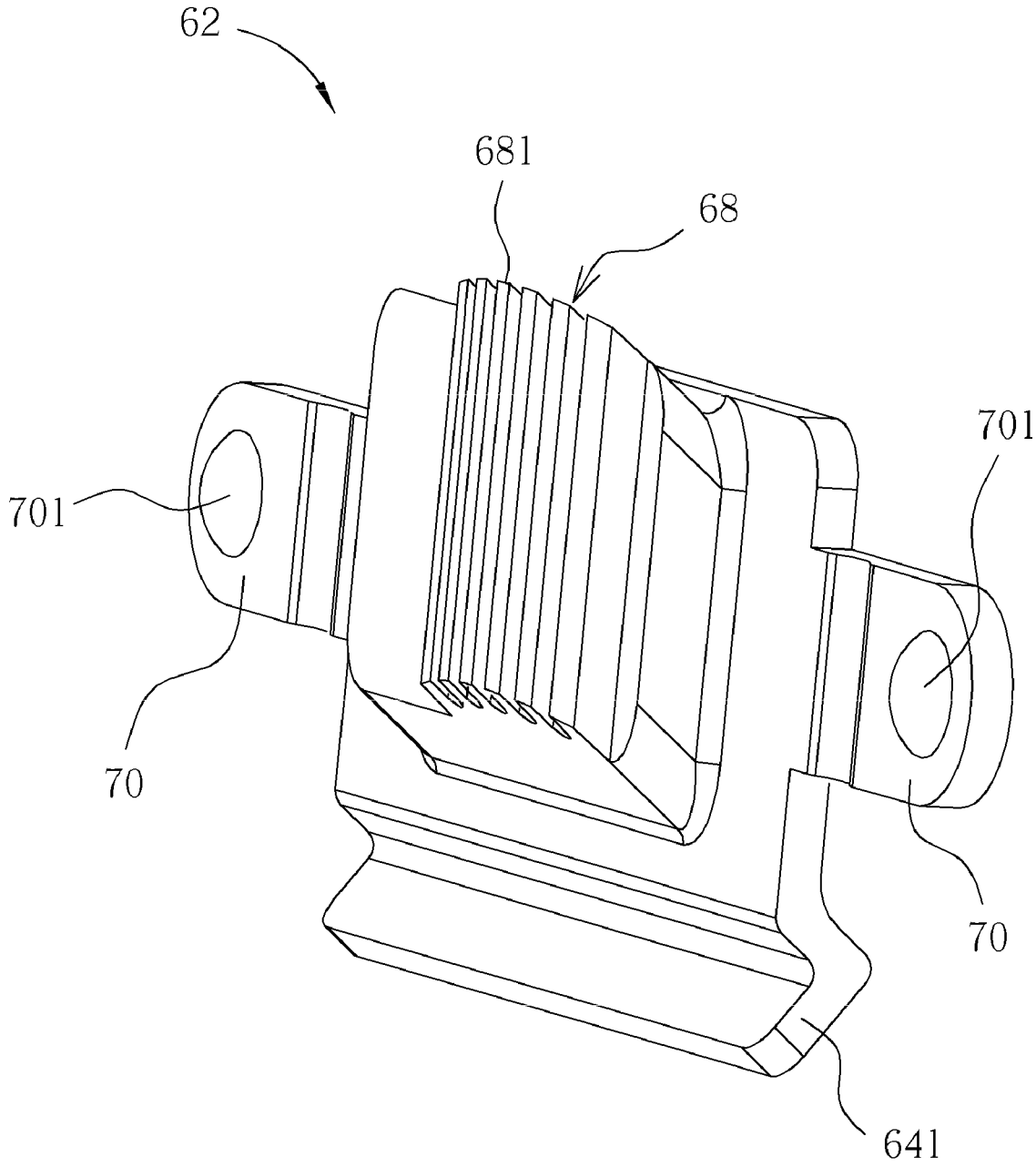
FIG. 4 and FIG. 5 are drawings of a sliding key mechanism in different views according to the preferred embodiment of the present invention.
Figure 5:
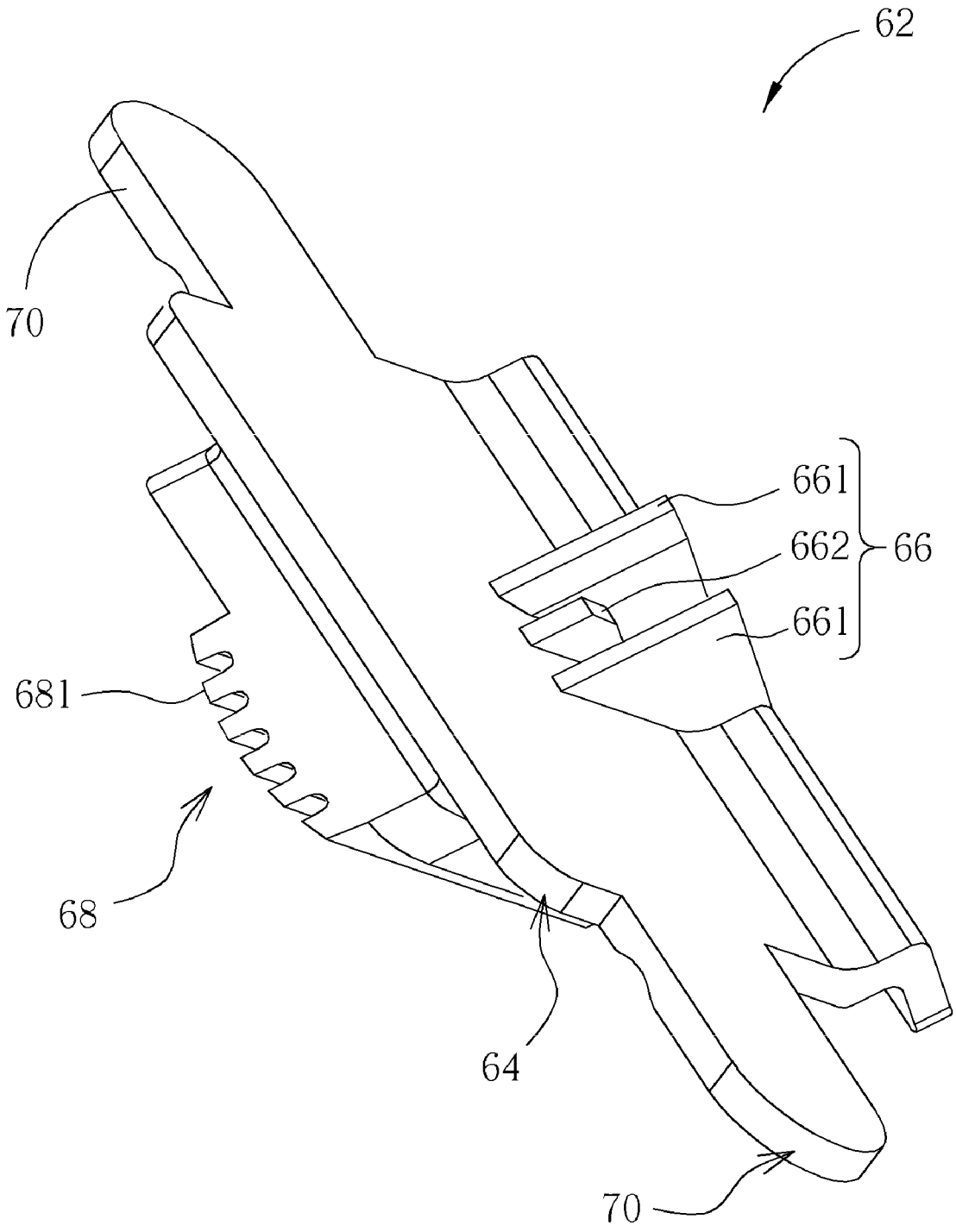
Figure 6:
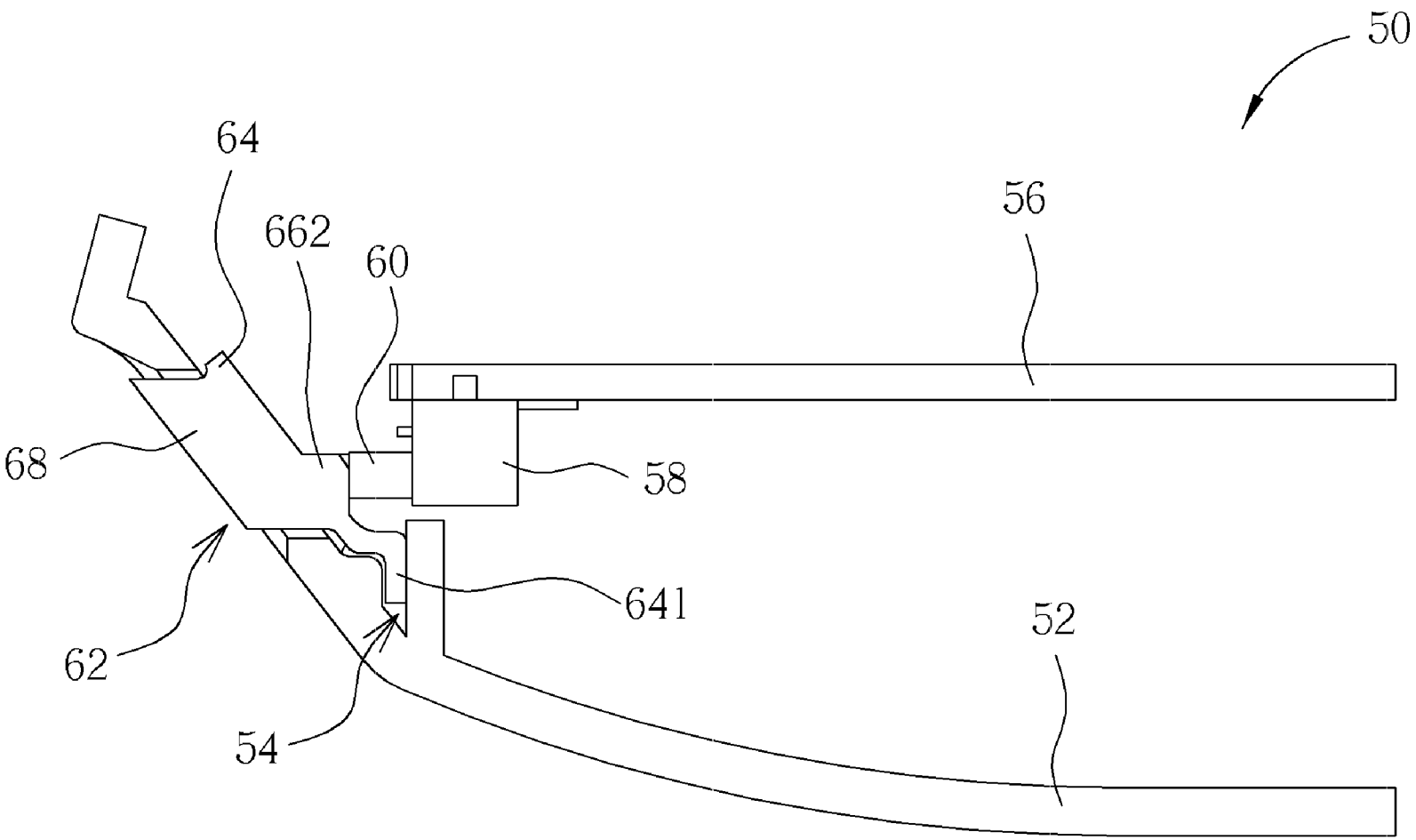
FIG. 6 is a sectional view of the sliding key mechanism along the line 6-6' in FIG. 2 according to the preferred embodiment of the present invention.
Figure 7:
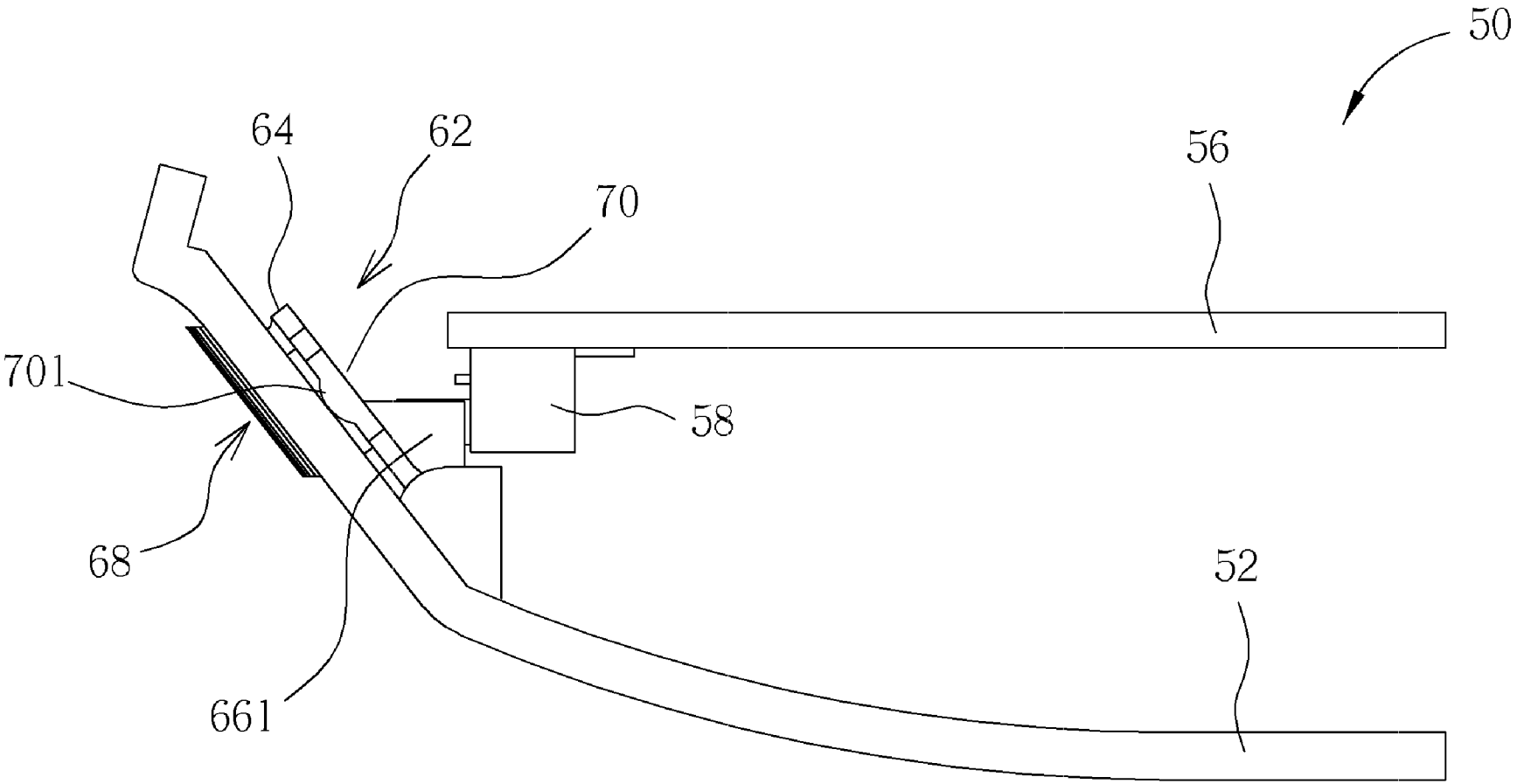
FIG. 7 is a sectional view of the sliding key mechanism along the line 7-7' in FIG. 2 according to the preferred embodiment of the present invention.

Please refer to FIG. 1 to FIG. 7. FIG. 4 and FIG. 5 are drawings of the sliding key mechanism 62 in different views according to the preferred embodiment of the present invention. FIG. 6 is a sectional view of the sliding key mechanism 62 along the line 6-6' in FIG. 2 according to the preferred embodiment of the present invention. FIG. 7 is a sectional view of the sliding key mechanism 62 along the line 7-7' in FIG. 2 according to the preferred embodiment of the present invention. The sliding key mechanism 62 includes a main body 64 for fixing inside the slot 54 of the housing 52. A hook structure 641 is formed on an end of the main body 64 for wedging into the slot 54 on the housing 52 for providing constraint of the sliding key mechanism 62 on the housing 52.

The sliding key mechanism 62 further includes a sliding actuator 66 connected to a side of the main body 64. The sliding actuator 66 and the main body 64 can be connected integrally. The sliding actuator 66 is for containing the sliding head 60 of the sliding switch 58 so as to drive the sliding head 60. The sliding actuator 66 includes two lateral walls 661 against the sliding head 60 in a direction whereto the sliding actuator 66 slides the sliding head 60 (±X direction). The sliding actuator 66 further includes a protrusion 662 disposed between the two lateral walls 661 and against the sliding head 60 perpendicularly to the direction whereto the sliding actuator 66 slides the sliding head 60 (Y direction). The two lateral walls 661 and the protrusion 662 can constrain the sliding head 60 of the sliding switch 58 tightly in the sliding actuator 66 so that the sliding actuator 66 can drive the sliding head 60 effectively.

Please refer to FIG. 2 and FIG. 5, the sliding key mechanism 62 further includes a key portion 68 connected to the other side of the main body 64. The key portion 68 and the main body 64 can be connected integrally. When the main body 64 is fixed inside the slot 54 of the housing 52, the key portion 68 protrudes through an opening 521 on the housing 52 so that the user can slide the key portion 68. When the key portion 68 slides for driving the sliding actuator 66, the sliding actuator 66 slides the sliding head 60 of the sliding switch 58 simultaneously. In this embodiment, a plurality of rib structures 681 is formed on the key portion 68 for providing friction between the user's fingers and the key portion 68 so as to slide the key portion 68 smoothly.

Figure 8:
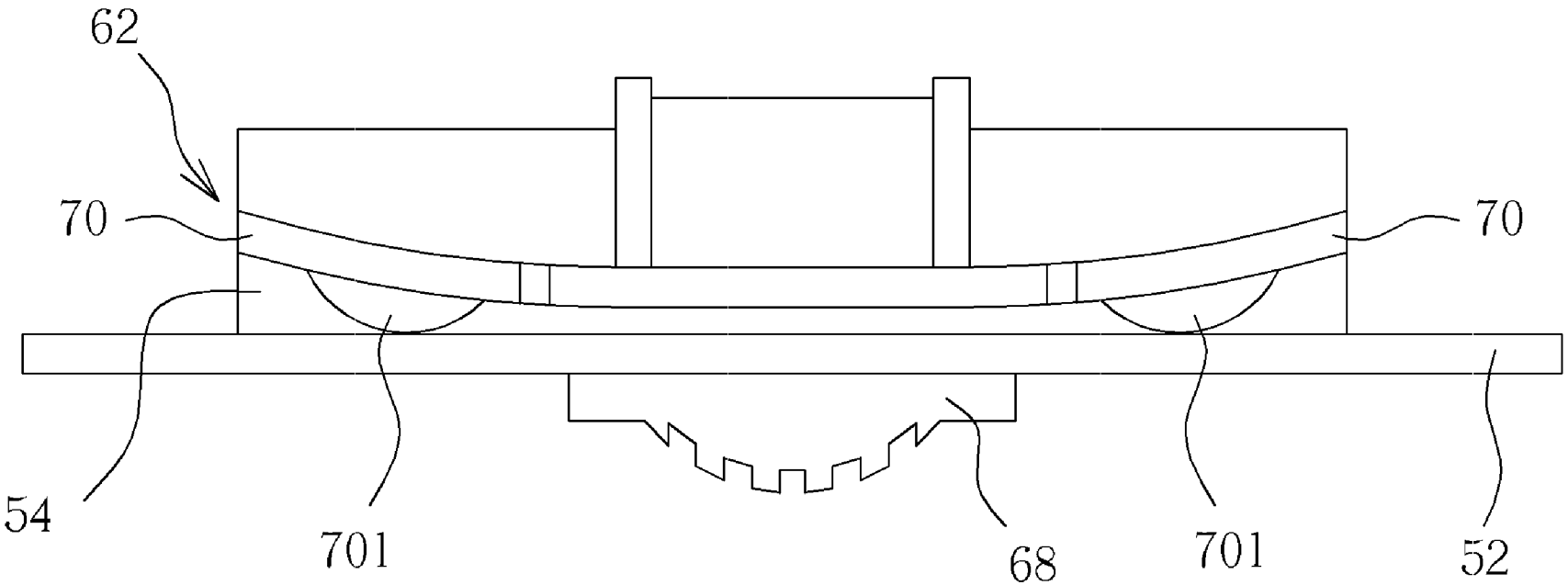
FIG. 8 is a diagram illustrating the sliding key mechanism wedging into a slot on a housing according to the preferred embodiment of the present invention.

Please refer to FIG. 3 and FIG. 8. FIG. 8 is a diagram illustrating the sliding key mechanism 62 wedging into the slot 54 on the housing 52 according to the preferred embodiment of the present invention. The sliding key mechanism 62 further includes two elastic components 70 connected to both ends of the main body 64 respectively. The two elastic components 70 and the main body 64 can be connected integrally. Each elastic component 70 can be a cantilever. A dome 701 is formed on each elastic component 70 for contacting against the housing 52 so as to bend the two elastic components 70. That is, when the hook structure 641 of the main body 64 wedges into the slot 54 on the housing 52, there is interference generated by elastic force between the two elastic components 70 and the housing 52 due to the domes 701 so that the two elastic components 70 are bent and contact against the housing 52 elastically for being fastened inside the housing 52 tightly. It can prevent seesaw and swaying drawbacks of the sliding key mechanism 62.

In contrast to the prior art, the sliding key mechanism of the present invention utilizes interference of the electric components and the housing for fastening the sliding key mechanism inside the housing tightly so as to prevent seesaw and swaying drawbacks. Therefore, it can improve using feeling of the sliding switch effectively.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A sliding key mechanism comprising:
- a main body fixed inside a slot on a housing;
- a sliding actuator connected to a side of the main body for containing a sliding head of a sliding switch;
- a key portion connected to the other side of the main body for driving the sliding actuator simultaneously when the key portion slides so that the sliding actuator slides the sliding head of the sliding switch;
- two elastic components connected to both ends of the main body respectively, and the two elastic components being bent when the main body is fixed inside the slot on the housing so that the two elastic components contact against the housing elastically; and
- a hook structure formed on an end of the main body for wedging into the slot on the housing.

2. The sliding key mechanism of claim 1 wherein the sliding actuator comprises two lateral walls against the sliding head in a direction whereto the sliding actuator slides the sliding head.

3. The sliding key mechanism of claim 1 wherein the sliding actuator comprises a protrusion against the sliding head perpendicularly to a direction whereto the sliding actuator slides the sliding head.

4. The sliding key mechanism of claim 1 wherein a plurality of rib structures is formed on the key portion.

5. The sliding key mechanism of claim 1 wherein a dome is formed on each elastic component for contacting against the housing so as to bend the two elastic components.

6. The sliding key mechanism of claim 1 wherein each elastic component is a cantilever.

7. The sliding key mechanism of claim 6 wherein a dome is formed on each cantilever for contacting against the housing so as to bend the two elastic components.

8. An electronic device comprising:
- a housing whereon a slot is formed;
- a circuit board installed inside the housing;
- a sliding switch installed inside the housing and disposed on the circuit board, the sliding switch comprising a sliding head; and
- a sliding key mechanism installed on the housing, the sliding key mechanism comprising:
  - a main body fixed inside the slot on the housing;
  - a sliding actuator connected to a side of the main body for containing the sliding head of the sliding switch;
  - a key portion connected to the other side of the main body for driving the sliding actuator simultaneously when the key portion slides so that the sliding actuator slides the sliding head of the sliding switch;
- two elastic components connected to both ends of the main body respectively, and the two elastic components being bent when the main body is fixed inside the slot on the housing so that the two elastic components contact against the housing elastically; and
- a hook structure formed on an end of the main body for wedging into the slot on the housing.

9. The electronic device of claim 8 wherein the sliding actuator comprises two lateral walls against the sliding head in a direction whereto the sliding actuator slides the sliding head.

10. The electronic device of claim 8 wherein the sliding actuator comprises a protrusion against the sliding head perpendicularly to a direction whereto the sliding actuator slides the sliding head.

11. The electronic device of claim 8 wherein a plurality of rib structures is formed on the key portion.

12. The electronic device of claim 8 wherein a dome is formed on each elastic component for contacting against the housing so as to bend the two elastic components.

13. The electronic device of claim 8 wherein each elastic component is a cantilever.

14. The electronic device of claim 13 wherein a dome is formed on each cantilever for contacting against the housing so as to bend the two elastic components.

15. A sliding key mechanism comprising:

a main body fixed inside a slot on a housing;

a sliding actuator connected to a side of the main body for containing a sliding head of a sliding switch, the sliding actuator comprising a protrusion against the sliding head perpendicularly to a direction whereto the sliding actuator slides the sliding head;

a key portion connected to the other side of the main body for driving the sliding actuator simultaneously when the key portion slides so that the sliding actuator slides the sliding head of the sliding switch; and two elastic components connected to both ends of the main body respectively, and the two elastic components being bent when the main body is fixed inside the slot on the housing so that the two elastic components contact against the housing elastically.

16. The sliding key mechanism of claim 15 wherein the sliding actuator comprises two lateral walls against the sliding head in a direction whereto the sliding actuator slides the sliding head.

17. The sliding key mechanism of claim 15 wherein a plurality of rib structures is formed on the key portion.

18. The sliding key mechanism of claim 15 wherein a dome is formed on each elastic component for contacting against the housing so as to bend the two elastic components.

19. The sliding key mechanism of claim 15 wherein each elastic component is a cantilever.

20. The sliding key mechanism of claim 19 wherein a dome is formed on each cantilever for contacting against the housing so as to bend the two elastic components.

* * * * *